US005172621A

United States Patent [19]

Minarelli et al.

[11] Patent Number: 5,172,621

[45] Date of Patent: Dec. 22, 1992

[54] DEVICE FOR CUTTING STRIP MATERIAL IN A WRAPPING MACHINE

[75] Inventors: Alessandro Minarelli; Alver Tacchi, both of Bologna, Italy

[73] Assignee: G. D. Societa Per Azioni, Bologna, Italy

[21] Appl. No.: 743,186

[22] Filed: Aug. 9, 1991

[30] Foreign Application Priority Data

Aug. 24, 1990 [IT] Italy ..... 3638 A/90

[51] Int. Cl.[5] ..... B26D 1/22

[52] U.S. Cl. ..... 83/152; 83/302; 83/346; 83/505; 83/408

[58] Field of Search ..... 83/100, 302, 332, 346, 83/505, 343, 408, 423, 903, 506, 304, 305, 347, 476, 152

[56] References Cited

U.S. PATENT DOCUMENTS

| | | | |
|---|---|---|---|
| 989,770 | 4/1911 | Egli | 83/476 |
| 1,290,301 | 1/1919 | Novick | 83/346 |
| 2,237,759 | 4/1941 | Kwitek | 83/302 |
| 2,482,118 | 9/1949 | Matthews | 83/305 |
| 3,174,372 | 3/1965 | Huck | 83/152 |
| 3,496,820 | 2/1970 | Utzmann et al. | 83/506 |
| 3,875,836 | 4/1975 | Hutchinson et al. | 83/302 |
| 4,080,856 | 3/1978 | Shearon | 83/100 |
| 4,114,355 | 9/1978 | Davies et al. | 83/152 |
| 4,856,400 | 8/1989 | Kelzer | 83/347 |

FOREIGN PATENT DOCUMENTS

| | | |
|---|---|---|
| 907069 | 10/1962 | United Kingdom . |
| 1092553 | 11/1967 | United Kingdom . |
| 1123536 | 8/1968 | United Kingdom . |
| 1303838 | 1/1973 | United Kingdom . |
| 1468571 | 3/1977 | United Kingdom . |

*Primary Examiner*—Frank T. Yost
*Assistant Examiner*—Allan M. Schrock
*Attorney, Agent, or Firm*—Cushman, Darby & Cushman

[57] ABSTRACT

In a device for cutting strip material as used in automatic wrapping machines, including transverse and longitudinal cutters by use of which the continuous strip is divided up into individual wrappers, the two cutters operate in conjunction with a reaction element serving additionally to support, retain and convey the strip in such a way that the material remains in a correct feed and cut position at least during its passage through the device. To advantage, a single reaction element can be utilized with the two cutters, and in the event that these are conventional, the first with a straight transverse blade and the second with a circumferential blade, the reaction surface is provided by a cylindrical roller.

3 Claims, 2 Drawing Sheets

DEVICE FOR CUTTING STRIP MATERIAL IN A WRAPPING MACHINE

BACKGROUND OF THE INVENTION

The present invention relates to a device for cutting strip material in a wrapping machine. One conventional device of the type in question, widely utilized for cutting a continuous strip of silver paper (i.e., aluminum foil-paper laminate) into discrete lengths or wrappers suitable for enveloping groups of cigarettes, importantly includes a transverse blade and a longitudinal blade.

The blades rotate about mutually parallel axes disposed at right angles to the feed direction of the strip material, and operate in conjunction with corresponding reaction means rotatable about axes parallel to the axes of rotation of the blades. The strip is fed in a continuous fashion, descending freely and thus substantially unchecked during its downward movement, to the point of engaging at bottom against a stop which serves both as a travel limiter and as a means for ensuring that the cut wrapper is positioned correctly in relation to the commodity (i.e. article) that is to be wrapped.

The blades and their respective reaction means are positioned on opposite sides of the descending strip, and timed to cut into the material at a given moment during its descent.

Such cutting devices are affected by drawbacks when operated at the high speeds typical of more modern wrapping machines.

While a faster operating speed of the blades alone is easily obtainable, an increase in the feed rate of the strip material is not so readily achieved. In effect, wrapping materials of this type are, in general, extremely lightweight, so that operation of the relative feed means at a higher speed does not necessarily translate into a correspondingly faster passage of the strip through the cutting device. Moreover, a faster rate of feed results in a more violent impact of the transverse leading edge of the strip against the stop, and consequently in damage to that leading edge.

SUMMARY OF THE INVENTION

Accordingly, an object of the present invention is to provide a cutting device capable of achieving notably high operating speeds both with ease, and without exhibiting the drawbacks mentioned above.

The stated object is achieved in a device according to the invention, comprising respective means by which to effect transverse and longitudinal cuts in a strip of material that is directed continuously into a wrapping machine at a prescribed and selectable velocity.

In the device disclosed, the transverse and the longitudinal cutting means operate in conjunction with corresponding reaction means serving also simultaneously to support, retain and convey the strip in such a way that the material is maintained constantly in a correct feed and cutting position, at least during its passage through the device.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
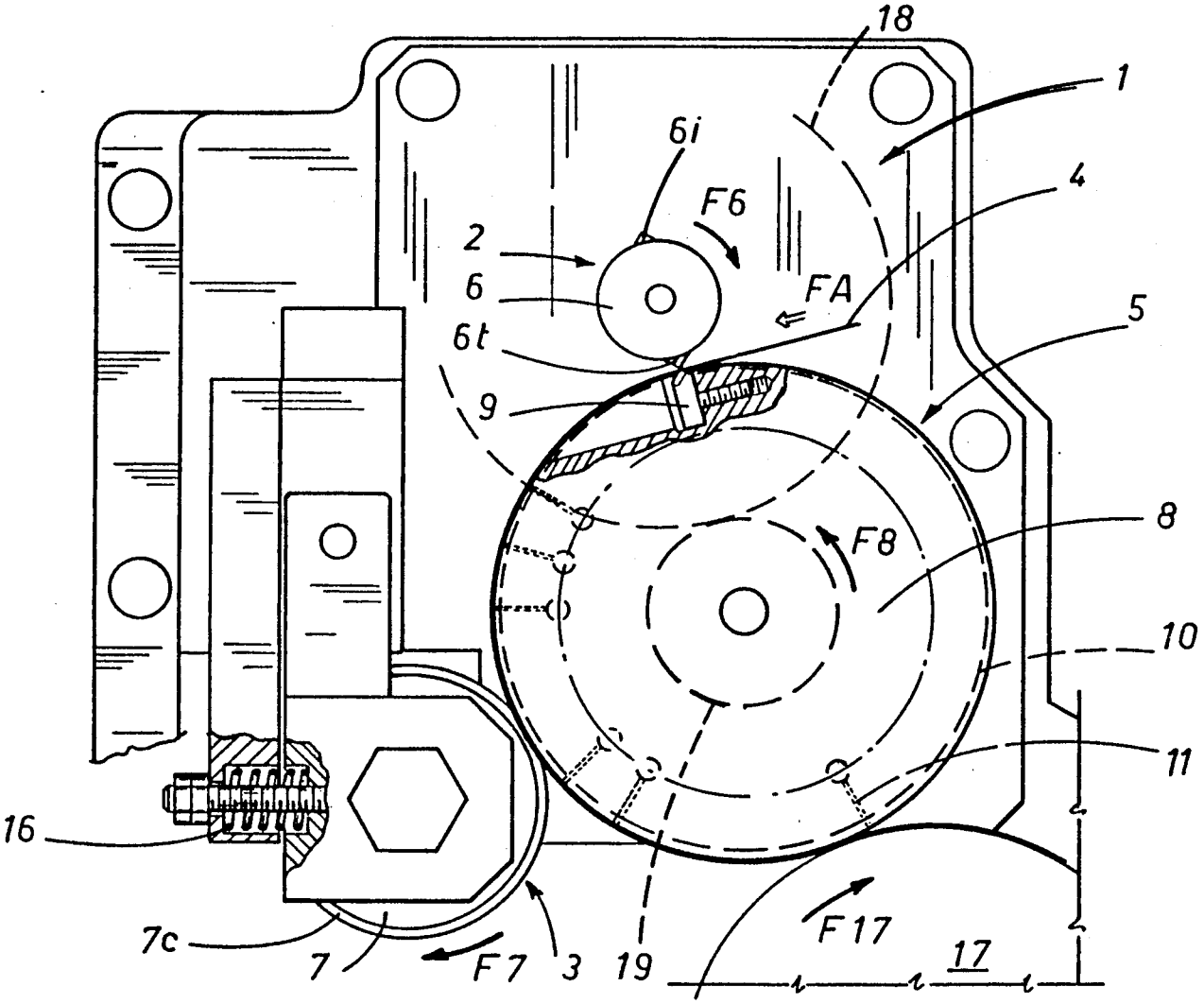
FIG. 1 is a schematic side elevation of a device according to the invention, viewed with certain parts omitted and others shown in section for greater clarity.

With reference to the above identified drawings, the numeral 1 denotes a device according to the invention, in its entirety, comprising means 2 and 3 by which respectively to effect transverse and longitudinal cuts in a strip of wrapping material, e.g. silver paper, denoted 4. The cutting means 2 and 3 operate in conjunction with reaction means 5 that are embodied in such a manner as to support, retain and convey the strip 4 and thus ensure that the position of the material is constantly controlled along the full distance of its passage through the cutting device.

Reference is made in the present specification to an embodiment of the device, illustrated purely by way of example in the accompanying drawings, of which the cutting means 2 and 3 are designed in such a way as to operate in conjunction with the same reaction means 5.

In the device 1 illustrated, transverse cutting means 2 include in a first cutter 6 that is rotatable about a horizontal axis and has two diametrically opposed straight-edge blades **6*t* and 6*i*, which are capable both of effecting a continuous cut across the width of the strip 4** in such a way as to sever a discrete length or wrapper, and of producing a series of transversely aligned slits serving to mark off an area of the wrapper rendered easily detachable from the remainder.

Longitudinal cutting means 3 include a second cutter 7, that is rotatable about an axis parallel to the axis of the first cutter 6 and is equipped with a circumferential blade **7*c*. The axes of rotation of the cutters 6 and 7 are disposed normal to the feed direction of the strip 4** and transversely parallel to the strip itself, at least in the areas where the cuts are effected.

According to the present invention, the reaction means comprise a cylindrical roller 8 interacting with both cutters 6 and 7, which roller is rotatable about a longitudinal axis disposed parallel with the axes of rotation of the two cutters 6 and 7. The first cutter 6 is situated substantially over the topmost generatrix of the cylindrical roller 8, while the second cutter 7 occupies a position following that of the first, in relation to the rotation of the roller 8.

Observing FIG. 1, it will be seen that the roller 8 carries a strike plate 9 that is positioned to interact with the blades **6*t* and 6*i* of the transverse cutting means 2, and, given that the plate 9 is to engage both blades 6*t* and 6*i*, its angular velocity will be twice that of the cutter 6. Clearly enough, the rotational speeds of the cutter 6 and the roller 8 are timed such that whenever the striking plate 9 moves into alignment with the two axes of rotation, it encounter one of the two blades, i.e., blade 6*t* or blade 6*i***.

Generally, these two blades **6*t* and 6*i* will differ from one another in that one, for example the blade denoted 6*t*, is designed to effect a full transverse cut through the strip 4, whereas the other blade, for example the blade 6*i* effects a series of incisions (i.e., provides a line of weakness) aligned transversely across the strip 4. The necessary timing of the cutter 6 and the roller 8 is obtained, for example, by means of a pair of gears 18** and 19 which are associated mechanically with the two members and are engaged in constant mesh, as shown schematically in FIG. 1.

Figure 2:
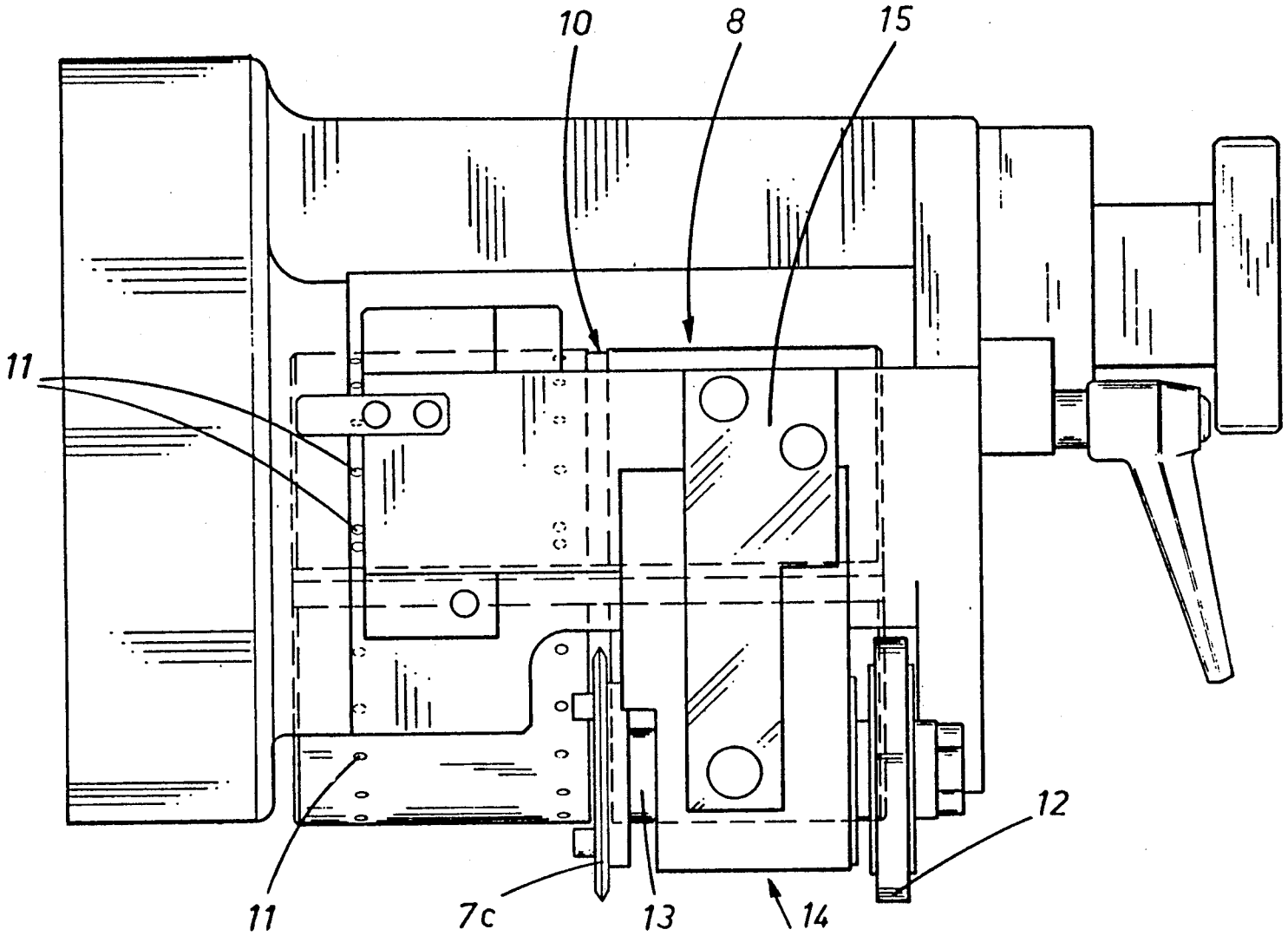
FIG. 2 is a schematic frontal elevation of the device of FIG. 1, viewed with certain parts omitted and others shown in section for greater clarity.

As is discernible from FIG. 2, the roller 8 exhibits a circumferential area or track 10 positioned so as to interact with the longitudinal cutter 7. Thus, circumferential blade 7c and the roller 8 rotate at identical peripheral velocities.

The mechanical associations between the cutters 6 and 7 and the roller 8 are such that the latter rotates in the opposite direction to both of the former (see arrows F6, F7 and F8).

To guarantee that the peripheral velocities of the second cutter 7 and the roller 8 are identical, the cutter is associated mechanically with a coaxial drive wheel denoted 12.

The second cutter 7 and the wheel 12 are keyed to the opposite ends of a shaft 13 that is carried freely in a frame 14 hinged to a structure 15 by which the cutters 6 and 7 and the roller 8 are all supported, together with suitable drive means of conventional embodiment (not illustrated). The hinged frame 14 is tensioned by adjustable spring means 16, serving to maintain the drive wheel 12 in contact with the reaction roller 8. The wheel 12, or at least its peripheral surface, is faced with material having a high coefficient of friction, for example rubber, in such a way that rotation is transmitted from the roller 8 to the cutter 7 by way of the wheel 12.

As is discernible from FIG. 1, the transverse blades 6t and 6i and the striking plate 9 are all associated, interchangeably and adjustably, with respective supporting elements.

The blade 7c of the longitudinal cutting means 3 is utilized normally to effect a plurality of aligned cuts, and, accordingly, the geometry of the track 10 is such that its distance from the axis of rotation of the roller 8 varies between a minimum value of contact with the edge of the blade 7c and a maximum value at which there is no contact (see FIG. 1).

The cylindrical surface of the roller 8 has a plurality of holes 11, which are discernible in both of the drawing figures, which can be connected to a source of negative pressure (not illustrated). Preferably, the holes 11 occupy a part of the roller 8 that is remote from the striking plate 9, for a reason that will shortly become clear.

Advantageously, and by way of means not illustrated, the holes 11 are connected to negative pressure only through an arc that extends, considered in the direction of rotation, from a point immediately prior to the first cutter 6 to a point beyond the second cutter 7 near to the bottom-most generatrix of the roller 8.

The strip 4 is fed to the roller 8 through a near horizontal path (arrow FA, FIG. 1), entering into contact with the cylindrical surface at a point immediately preceding the cutter 6, conveyed by relative means (not illustrated) at a velocity that is nominally less than the surface velocity of the roller 8.

Given the difference between the feed rate of the strip 4 and the surface speed of the roller 8, the cylindrical surface of the roller will be perfectly smooth, in such a way as to favor sliding contact with the strip 4.

The numeral 17 denotes a further roller that is positioned below the reaction roller 8, is rotatable in the same direction (see arrow F17) and is furnished likewise with radial holes (not illustrated) that can be connected to a source of negative pressure. More exactly, this further roller 17 is offered tangentially to the position at which the holes 11 of the reaction roller 8 cease to generate suction, in such a way that the leading edge of the strip 4 is taken up onto its surface (see FIG. 1).

In a cutting device 1 thus embodied, the strip 4 is directed onto the surface of the reaction roller 8, free of any excessive tension that could result in damage to the material. As the first blade 6i and the striking plate 9 come together, the strip 4 is pierced by the cutting edge with a succession of transversely aligned and equispaced incisions (i.e., a line of weakness is provided.)

Thereafter, the strip 4 is severed transversely by the remaining blade 6t of the first cutter and a discrete length or wrapper is thus separated from the main body of material. At this juncture, given that the surface speed of the roller 8 is greater than that of the running strip 4, the discrete wrapper is distanced from the remainder of the strip and conveyed from the device 1 by the bottom roller 17. At a given point in the passage of the strip around the roller 8, the depth of the track 10 becomes such that the strip 4 is penetrated by the second cutter 7, resulting in a series of longitudinally aligned and uniformly distributed cuts (i.e., a line of weakness) being provided.

The length of each wrapper separated from the strip is determined by the feed velocity of the strip and the angular velocity of the transverse cutter 6.

The retaining action produced by suction through the holes 11 in no way compromises the integrity of the strip 4 which is, already pierced with transverse slits by the relative blade 6i, given that the cut is effected on a stretch of the material that is remote from the holes 11.

To obtain a better transverse cut of the strip 4, the blades 6t and 6i and the striking plate 9 can be angled in such a way as to engage the material in the manner of a scissor.

Numerous advantages are provided by the invention, first among which is the certainty that both the continuous strip and the discrete wrappers will be fed in regular fashion and in the same direction with no risk of diversion, by virtue of the fact that the passage of the strip 4 through the cutting device 1 is entirely controlled. Moreover, added certainty derives from the fact that the feed means which convey the strip 4 and the reaction means that interact with the cutters 6 and 7 are one and the same.

The device disclosed is also able to ensure that wrappers will reach the following work station safe and intact, especially at the leading edge, due to the retention of the material in the manner described. This same retention, first of the strip, and thereafter of the separated wrappers, permits one to obtain considerably increased operating and feed speeds.

What is claimed:

1. A device for cutting a continuous strip of flexible sheet material that is being advanced longitudinally into the device along a path at a first given speed, into a succession of discrete wrappers delivered along said path to an outlet of the device.

said device comprising:

a reaction means rotated about a horizontal axis and having an outer peripheral surface which is generally tangent to said path generally along an uppermost generatrix of said outer peripheral surface, said outer peripheral surface thereby having a second given speed along said path which is slightly faster than said first given speed;

a take-off roller rotated about a horizontal axis and having an outer peripheral surface which is tangentially juxtaposed with said outer peripheral surface of said reaction means, at an outlet of said device, at a location which generally coincides with a lowermost generatrix of said outer peripheral device, said take-off roller being arranged to progressively and successively take off of said outer peripheral surface of said reaction means onto said outer peripheral surface of said take-off roller each of said succession of discrete wrappers;

said reaction means including a generally transversally extending, radially outwardly presented striking plate means disposed as an interruption of said outer peripheral surface of said reaction means;

said reaction means further including intermediate transversally opposite ends thereof a circumferentially extending, radially outwardly presented track disposed as an interruption of said outer peripheral surface of said reaction means;

a first rotary cutting means rotated about a horizontal axis and having a first radially outwardly presented, transversally extending cutter arranged to be cyclically rotated, by rotation of said first rotary cutting means, into cutting tangency with said striking plate means of said reaction means at a first cutting station located adjacent, but rotationally downstream along said path from said uppermost generatrix of said outer peripheral surface of said reaction means, so that each time said first cutter is rotated into cutting tangency with said striking plate, a wrapper is completely severed from a leading end portion of said continuous strip;

a second rotary cutting means rotated about a horizontal axis and having a radially outwardly presented circumferential cutter disposed to be rotated, by rotation of said second rotary cutting means, into cutting tangency with said track of said reaction means at a longitudinal cutting location on said path that is disposed rotationally intermediate where said first rotary cutting means severs each wrapper from said leading end portion of said strip, and where said take-off roller progressively and successively takes said wrappers off of said outer peripheral surface of said reaction means, during at least a given portion of each cycle of rotation of said reaction means, for thereby, while so disposed in cutting tangency, making at least one longitudinal cut in each said wrapper at a location disposed intermediate transversally opposite edges of such wrapper;

means providing a plurality of circumferentially widely distributed radially outwardly acting suction openings in said outer peripheral surface of said reaction means, and for serving with suction only such portion of said suction openings as are at and given time located along said path between where said path initially becomes tangent to said outer peripheral surface of said reaction means and a location that is rotationally intermediate said longitudinal cutting location and where said take-off roller progressively and successively takes said wrappers off of said outer peripheral surface of said reaction means; said suction opening providing means, and said outer peripheral surface of said reaction means being constructed and operated so as to permit said leading edge portion of said strip to slip relatively upstream along said radially outer peripheral surface of said reaction means while disposed in suction-induced tractive engagement with said outer peripheral surface of said reaction means, but each wrapper, upon being severed from said strip to be conveyed along said path at said second given speed;

said second rotary cutting means and said track being cooperatively arranged such that said second rotary cutting means is rotated into cutting tangency with said track during only said given portion of each cycle of rotation of said reaction means, and said given portion is less than all of said cycle, so that each wrapper is, as a result, discontinuously longitudinally cut by said second rotary cutting means.

2. The cutting device of claim 1, wherein:

said second rotary cutting means is rotated about the respective said horizontal axis by a friction drive wheel that is effectively coupled therewith and disposed in driven relation to said reaction means.

3. The cutting device of claim 1, wherein:

said reaction means and said first rotary cutting means rotated about the respective said horizontal axes by coordinated means which cause said striking plate means to make precisely two revolutions for each revolution of said first cutter; and said first rotary cutting means of said cutting device further includes:

a second radially outwardly presented, transversally extending cutter arranged to be cyclically rotated, by rotation of said first rotary cutting means, into cutting tangency with said striking plate means of said second reaction means at said first cutting station, said second cutter of said first rotary cutting means being configured to make a discontinuous cutting line transversally across said strip.

* * * * *